US009472063B2

(12) United States Patent
Nicely et al.

(10) Patent No.: US 9,472,063 B2
(45) Date of Patent: Oct. 18, 2016

(54) GAMING SYSTEM AND METHOD FOR PROVIDING A MULTIPLE SIDED CARD GAME

(71) Applicant: IGT, Reno, NV (US)

(72) Inventors: Mark C. Nicely, Daly City, CA (US); Ana Rollins, San Francisco, CA (US); Colin Ferris, San Francisco, CA (US); John Grime, Foster City, CA (US); Bryan D. Wolf, Reno, NV (US)

(73) Assignee: IGT, Las Vegas, NV (US)

( * ) Notice: Subject to any disclaimer, the term of this patent is extended or adjusted under 35 U.S.C. 154(b) by 634 days.

(21) Appl. No.: 13/625,947

(22) Filed: Sep. 25, 2012

(65) Prior Publication Data

US 2014/0087798 A1 Mar. 27, 2014

(51) Int. Cl.
*G07F 17/32* (2006.01)

(52) U.S. Cl.
CPC ..... *G07F 17/3293* (2013.01); *G07F 17/326* (2013.01)

(58) Field of Classification Search
CPC ..... G07F 17/32; G07F 17/326
USPC ..... 463/11
See application file for complete search history.

(56) References Cited

U.S. PATENT DOCUMENTS

| | | | |
|---|---|---|---|
| 821,781 | A | 5/1906 | Cadwallader |
| 1,551,761 | A | 9/1925 | McCarroll |
| 1,568,206 | A | 1/1926 | Brandt |
| 1,681,683 | A | 8/1928 | Ramer |
| 2,077,124 | A | 4/1937 | Miller |
| 2,545,644 | A | 3/1951 | Benton |
| 3,633,915 | A | 1/1972 | Lippert |
| 3,819,186 | A | 6/1974 | Hinterstocker |
| 3,831,945 | A | 8/1974 | Scherini |
| 4,157,829 | A | 6/1979 | Goldman et al. |
| 4,170,358 | A | 10/1979 | Hancock |
| 4,198,052 | A | 4/1980 | Gauselmann |
| 4,335,809 | A | 6/1982 | Wain |
| 4,339,798 | A | 7/1982 | Hedges et al. |

(Continued)

FOREIGN PATENT DOCUMENTS

| | | |
|---|---|---|
| EP | 2 19 305 | 4/1987 |
| EP | 3 75 190 | 6/1990 |

(Continued)

OTHER PUBLICATIONS

'Magic: The Gathering' description, printed from wikipedia.org on Jun. 18, 2012 (21 pages.).

*Primary Examiner* — Omkar Deodhar
*Assistant Examiner* — Shauna-Kay Hall
(74) *Attorney, Agent, or Firm* — Neal, Gerber & Eisenberg LLP

(57) ABSTRACT

The present disclosure relates generally to gaming systems and methods for providing a card game that employs multiple-sided playing cards. In various embodiments, the gaming system enables a player to play one or more games which utilize one or more sets or decks of multiple-sided playing cards or multiple-sided tiles. In such embodiments, a first side of each multiple-sided playing card is associated with one of a plurality of playing cards from a first set or deck of playing cards for a first game and a second side of each multiple-sided playing card is associated with one of a plurality of playing cards from a second, different set or deck of playing cards for a second, different game.

24 Claims, 9 Drawing Sheets

(56) References Cited

U.S. PATENT DOCUMENTS 4,346,900 A 8/1982 Lamlee
4,448,419 A 5/1984 Telnaes
4,467,424 A 8/1984 Hedges et al.
4,492,378 A 1/1985 Williams
4,494,197 A 1/1985 Troy et al.
4,560,161 A 12/1985 Hamano
4,582,324 A 4/1986 Koza et al.
4,618,150 A 10/1986 Kimura
4,624,459 A 11/1986 Kaufman
4,652,998 A 3/1987 Koza et al.
4,669,730 A 6/1987 Small
4,689,742 A 8/1987 Troy et al.
4,695,053 A 9/1987 Vazquez, Jr. et al.
4,732,386 A 3/1988 Rayfiel
4,743,022 A 5/1988 Wood
4,775,155 A 10/1988 Lees
4,805,907 A 2/1989 Hagiwara
4,815,741 A 3/1989 Small
4,817,951 A 4/1989 Crouch et al.
4,838,552 A 6/1989 Hagiwara
4,842,278 A 6/1989 Markowicz
4,856,787 A 8/1989 Itkis
4,926,327 A 5/1990 Sidley
4,941,665 A 7/1990 Klamer
4,982,337 A 1/1991 Burr et al.
5,019,973 A 5/1991 Wilcox et al.
5,042,809 A 8/1991 Richardson
5,085,436 A 2/1992 Bennett
5,092,598 A 3/1992 Kamille
5,100,137 A 3/1992 Fulton
5,158,293 A 10/1992 Mullins
5,167,413 A 12/1992 Fulton
5,184,821 A 2/1993 Korenek
5,205,555 A 4/1993 Hamano
5,209,479 A 5/1993 Nagao et al.
5,211,399 A 5/1993 Howard
5,251,897 A 10/1993 Fulton
5,255,915 A 10/1993 Miller
5,259,616 A 11/1993 Bergmann
5,265,874 A 11/1993 Dickinson et al.
5,276,312 A 1/1994 McCarthy
5,282,620 A 2/1994 Keesee
5,308,065 A 5/1994 Bridgeman et al.
5,324,035 A 6/1994 Morris et al.
5,324,041 A 6/1994 Boylan et al.
5,332,219 A 7/1994 Marnell, II et al.
5,356,140 A 10/1994 Dabrowski et al.
5,364,100 A 11/1994 Ludlow et al.
5,374,067 A 12/1994 Jones
5,382,025 A 1/1995 Sklansky et al.
5,393,061 A 2/1995 Manship et al.
5,395,111 A 3/1995 Inoue
5,398,932 A 3/1995 Eberhardt et al.
5,407,199 A 4/1995 Gumina
5,411,257 A 5/1995 Fulton
5,411,271 A 5/1995 Mirando
5,423,539 A 6/1995 Nagao
5,429,507 A 7/1995 Kaplan
5,437,451 A 8/1995 Fulton
5,449,173 A 9/1995 Thomas et al.
5,489,101 A 2/1996 Moody
5,525,915 A 6/1996 Farquhar et al.
5,531,440 A * 7/1996 Dabrowski et al. ..... 463/12
5,531,448 A 7/1996 Moody
5,536,016 A 7/1996 Thompson
5,540,442 A 7/1996 Orselli et al.
5,542,669 A 8/1996 Charron et al.
5,553,851 A 9/1996 Malavazos et al.
5,560,603 A 10/1996 Seelig et al.
5,584,763 A 12/1996 Kelly et al.
5,591,081 A 1/1997 Suzuki
5,611,535 A 3/1997 Tiberio
5,628,684 A 5/1997 Bouedec
5,630,754 A 5/1997 Rebane
5,636,838 A 6/1997 Caro
5,655,965 A 8/1997 Takemoto et al.
5,664,781 A 9/1997 Feola
5,674,128 A 10/1997 Holch et al.
5,722,891 A 3/1998 Inoue
5,732,950 A 3/1998 Moody
5,752,881 A 5/1998 Inoue
5,755,440 A 5/1998 Sher
5,755,621 A 5/1998 Marks et al.
5,769,716 A 6/1998 Saffari et al.
5,779,545 A 7/1998 Berg et al.
5,788,573 A 8/1998 Baerlocher et al.
5,800,269 A 9/1998 Holch et al.
5,803,809 A 9/1998 Yoseloff
5,807,172 A 9/1998 Piechowiak
5,816,916 A 10/1998 Moody
5,820,460 A 10/1998 Fulton
5,823,873 A 10/1998 Moody
5,823,874 A 10/1998 Adams
5,833,536 A 11/1998 Davids et al.
5,848,932 A 12/1998 Adams
5,851,148 A 12/1998 Brune et al.
5,871,398 A 2/1999 Schneier et al.
5,882,261 A 3/1999 Adams
5,890,962 A 4/1999 Takemoto
5,911,418 A 6/1999 Adams
5,919,089 A 7/1999 Rosati
5,919,091 A 7/1999 Bell et al.
5,935,002 A 8/1999 Falciglia
5,944,606 A 8/1999 Gerow
5,947,820 A 9/1999 Morro et al.
5,947,821 A 9/1999 Stone
5,947,831 A 9/1999 McCarthy
5,949,042 A 9/1999 Dietz, II et al.
5,951,397 A 9/1999 Dickinson
5,954,582 A 9/1999 Zach
5,984,781 A 11/1999 Sunaga
5,988,643 A 11/1999 Awada
5,989,121 A 11/1999 Sakamoto
5,997,401 A 12/1999 Crawford
6,004,207 A 12/1999 Wilson, Jr. et al.
6,007,066 A 12/1999 Moody
6,015,346 A 1/2000 Bennett
6,017,032 A 1/2000 Grippo et al.
6,024,640 A 2/2000 Walker et al.
6,045,129 A 4/2000 Cooper et al.
6,050,658 A 4/2000 O'Sullivan et al.
6,056,642 A 5/2000 Bennett
6,059,658 A 5/2000 Mangano et al.
6,086,066 A 7/2000 Takeuchi et al.
6,089,976 A 7/2000 Schneider et al.
6,089,977 A 7/2000 Bennett
6,089,982 A 7/2000 Holch et al.
6,093,101 A 7/2000 Mourad
6,098,985 A 8/2000 Moody
6,102,798 A 8/2000 Bennett
6,105,962 A 8/2000 Malavazos et al.
6,110,040 A 8/2000 Sanduski et al.
6,113,098 A 9/2000 Adams
6,120,378 A 9/2000 Moody
6,123,333 A 9/2000 McGinnis, Sr. et al.
6,126,542 A 10/2000 Fier
6,129,355 A 10/2000 Hahn et al.
6,132,311 A 10/2000 Williams
6,142,873 A 11/2000 Weiss et al.
6,142,874 A 11/2000 Kodachi et al.
6,146,272 A 11/2000 Walker et al.
6,149,521 A 11/2000 Sanduski
6,159,095 A 12/2000 Frohm et al.
6,159,098 A 12/2000 Slomiany et al.
6,162,121 A 12/2000 Morro et al.
6,164,652 A 12/2000 Lauretta et al.
6,168,520 B1 1/2001 Baerlocher et al.
6,168,521 B1 1/2001 Luciano et al.
6,173,955 B1 1/2001 Perrie et al.
6,174,233 B1 1/2001 Sunaga et al.
6,174,235 B1 1/2001 Walker et al.
6,183,361 B1 2/2001 Cummings et al.
6,190,254 B1 2/2001 Bennett
6,190,255 B1 2/2001 Thomas et al.

(56) References Cited

U.S. PATENT DOCUMENTS 6,200,217 B1 3/2001 Osawa
6,203,428 B1 3/2001 Giobbi et al.
6,209,869 B1 4/2001 Mathews
6,210,275 B1 4/2001 Olsen
6,210,276 B1 4/2001 Mullins
6,213,875 B1 4/2001 Suzuki
6,217,022 B1 4/2001 Astancha
6,217,448 B1 4/2001 Olsen
6,220,961 B1 4/2001 Keane et al.
6,224,483 B1 5/2001 Mayeroff
6,224,484 B1 5/2001 Okuda et al.
6,227,542 B1 5/2001 Cosmi
6,227,969 B1 5/2001 Yoseloff
6,227,970 B1 5/2001 Shimizu et al.
6,227,971 B1 5/2001 Weiss
6,231,442 B1 5/2001 Mayeroff
6,234,897 B1 5/2001 Frohm et al.
6,238,287 B1 5/2001 Komori et al.
6,241,606 B1 6/2001 Riendeau et al.
6,241,607 B1 6/2001 Payne et al.
6,251,013 B1 6/2001 Bennett
6,254,480 B1 7/2001 Zach
6,257,979 B1 7/2001 Walker et al.
6,261,177 B1 7/2001 Bennett
6,270,408 B1 8/2001 Sakamoto et al.
6,273,820 B1 8/2001 Haste, III
6,280,328 B1 8/2001 Holch et al.
6,287,194 B1 9/2001 Okada et al.
6,290,600 B1 9/2001 Glasson
6,299,165 B1 10/2001 Nagano
6,299,170 B1 10/2001 Yoseloff
6,305,686 B1 10/2001 Perrie et al.
6,309,298 B1 10/2001 Gerow
6,309,300 B1 10/2001 Glavich
6,311,978 B1 11/2001 Moody
6,312,334 B1 11/2001 Yoseloff
6,315,663 B1 11/2001 Sakamoto
6,315,664 B1 11/2001 Baerlocher et al.
6,319,124 B1 11/2001 Baerlocher et al.
6,325,716 B1 12/2001 Walker et al.
6,334,613 B1 1/2002 Yoseloff
6,334,814 B1 1/2002 Adams
6,336,860 B1 1/2002 Webb
6,336,863 B1 1/2002 Baerlocher et al.
6,342,007 B1 1/2002 Wood et al.
6,346,043 B1 2/2002 Colin et al.
6,347,996 B1 2/2002 Gilmore et al.
6,358,151 B1 3/2002 Enzminger et al.
6,364,767 B1 4/2002 Brossard et al.
6,368,218 B2 4/2002 Angell, Jr.
6,398,220 B1 6/2002 Inoue
6,398,644 B1 6/2002 Perrie et al.
6,402,614 B1 6/2002 Schneier et al.
6,413,162 B1 7/2002 Baerlocher et al.
6,419,579 B1 7/2002 Bennett
6,419,583 B1 7/2002 Crumby et al.
6,422,940 B1 7/2002 Walker et al.
6,443,837 B1 9/2002 Jaffe et al.
6,450,885 B2 9/2002 Schneier et al.
6,454,648 B1 9/2002 Kelly et al.
RE37,885 E 10/2002 Acres et al.
6,464,581 B1 10/2002 Yoseloff et al.
6,474,645 B2 11/2002 Tarantino
6,475,086 B2 11/2002 Zach
6,508,711 B1 1/2003 Ono
6,517,074 B1 2/2003 Moody et al.
6,524,184 B1 2/2003 Lind et al.
6,527,638 B1 3/2003 Walker et al.
6,533,279 B2 3/2003 Moody et al.
6,533,664 B1 3/2003 Crumby
6,537,150 B1 3/2003 Luciano et al.
6,561,898 B2 5/2003 Moody
6,568,680 B1 5/2003 Moody et al.
6,605,000 B2 8/2003 Adams
6,644,664 B2 11/2003 Muir et al.
6,652,377 B1 11/2003 Moody
6,659,863 B2 12/2003 Ashley et al.
6,663,448 B1 12/2003 Davies et al.
6,663,489 B2 12/2003 Baerlocher
6,672,959 B2 1/2004 Moody et al.
6,692,355 B2 2/2004 Baerlocher et al.
6,705,944 B2 3/2004 Luciano
6,729,961 B1 5/2004 Millerschone
6,749,502 B2 6/2004 Baerlocher
6,773,012 B1 8/2004 French
6,793,577 B1 9/2004 Wilkins et al.
6,827,646 B2 12/2004 Adams
6,855,052 B2 2/2005 Weiss et al.
D503,951 S 4/2005 Karstens
6,890,255 B2 5/2005 Jarvis et al.
6,935,950 B2 8/2005 Tarantino
6,955,356 B2 10/2005 Moody
6,964,416 B2 11/2005 McClintic et al.
D512,464 S 12/2005 Karstens
D512,465 S 12/2005 Karstens
6,988,731 B2 1/2006 Inoue
6,991,538 B2 1/2006 Cannon
6,994,624 B2 2/2006 Gold et al.
7,004,835 B2 2/2006 Baerlocher
7,022,016 B2 4/2006 Wood et al.
7,040,983 B2 5/2006 Dollof et al.
7,056,192 B2 6/2006 Venigalla et al.
7,056,206 B2 6/2006 Aoki et al.
7,056,209 B2 6/2006 Baerlocher et al.
7,059,965 B2 6/2006 Jackson
7,059,967 B2 6/2006 Baerlocher
7,066,814 B2 6/2006 Glavich et al.
7,128,646 B2 10/2006 Baerlocher et al.
7,137,628 B2 11/2006 Moody
7,144,321 B2 12/2006 Mayeroff
7,156,397 B2 1/2007 Moody et al.
7,179,169 B2 2/2007 Beaulien et al.
7,198,570 B2 4/2007 Rodgers et al.
7,204,488 B2 4/2007 Ilievski
7,210,997 B2 5/2007 Hughs-Baird et al.
7,222,856 B2 5/2007 Dodge
7,226,358 B2 6/2007 Miller et al.
7,247,092 B2 7/2007 Jarvis et al.
7,252,591 B2 8/2007 Van Asdale
7,294,055 B2 11/2007 Baerlocher et al.
7,297,057 B2 11/2007 Gerrard et al.
7,306,520 B2 12/2007 Kaminkow et al.
7,311,598 B2 12/2007 Kaminkow et al.
7,311,604 B2 12/2007 Kaminkow et al.
7,326,109 B2 2/2008 Baerlocher
7,354,342 B2 4/2008 Paulsen et al.
7,354,344 B2 4/2008 Paulsen et al.
7,399,226 B2 7/2008 Mishra
7,419,162 B2 9/2008 Lancaster et al.
7,476,542 B2 1/2009 Walker et al.
7,524,243 B2 4/2009 Bansemer et al.
7,641,197 B2 1/2010 Jackson
7,658,672 B1 2/2010 Wolf et al.
7,749,059 B2 7/2010 Tarantino
7,785,188 B2 8/2010 Cannon
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,857,693 B1 12/2010 Johnson et al.
7,993,191 B2 8/2011 Evans et al.
8,062,119 B2 11/2011 Stern et al.
8,100,748 B2 1/2012 Montross et al.
8,100,754 B2 1/2012 Bigelow, Jr. et al.
2002/0010013 A1 1/2002 Walker et al.
2002/0037761 A1 3/2002 Bennett
2002/0072404 A1 6/2002 Gerow
2002/0077167 A1 6/2002 Merari
2002/0094857 A1 7/2002 Meyer
2002/0098882 A1 7/2002 Lind et al.
2002/0098883 A1 7/2002 Packes, Jr. et al.
2002/0119814 A1 8/2002 Fong et al.
2002/0137559 A1 9/2002 Baerlocher
2002/0169018 A1 11/2002 Schneier et al.

(56) References Cited

U.S. PATENT DOCUMENTS

| | | | |
|---|---|---|---|
| 2003/0036420 | A1 | 2/2003 | Baerlocher et al. |
| 2003/0045338 | A1 | 3/2003 | Dolloff et al. |
| 2003/0064773 | A1 | 4/2003 | Baerlocher et al. |
| 2003/0078093 | A1 | 4/2003 | Simms et al. |
| 2003/0171143 | A1 | 9/2003 | Valdez et al. |
| 2003/0195027 | A1 | 10/2003 | Baerlocher et al. |
| 2004/0004324 | A1 | 1/2004 | Stefan |
| 2004/0009803 | A1 | 1/2004 | Bennett et al. |
| 2004/0014517 | A1 | 1/2004 | Inoue |
| 2004/0048645 | A1 | 3/2004 | Webb et al. |
| 2004/0048650 | A1 | 3/2004 | Mierau et al. |
| 2004/0053660 | A1 | 3/2004 | Webb et al. |
| 2004/0053665 | A1 | 3/2004 | Baerlocher |
| 2004/0248640 | A1 | 12/2004 | Kaminkow et al. |
| 2005/0026671 | A1 | 2/2005 | Baerlocher |
| 2005/0026673 | A1 | 2/2005 | Paulsen et al. |
| 2005/0054415 | A1 | 3/2005 | Kaminkow et al. |
| 2005/0054421 | A1 | 3/2005 | Hughs-Baird et al. |
| 2005/0059486 | A1 | 3/2005 | Kaminkow |
| 2005/0075159 | A1 | 4/2005 | Kaminkow et al. |
| 2005/0116417 | A1* | 6/2005 | Soltys et al. ..... 273/292 |
| 2005/0202863 | A1 | 9/2005 | Macaulay |
| 2005/0215307 | A1 | 9/2005 | Jarvis et al. |
| 2006/0025195 | A1 | 2/2006 | Pennington et al. |
| 2006/0030403 | A1 | 2/2006 | Lafky et al. |
| 2006/0040721 | A1 | 2/2006 | Cuddy et al. |
| 2006/0046821 | A1 | 3/2006 | Kaminkow et al. |
| 2006/0046822 | A1 | 3/2006 | Kaminkow et al. |
| 2006/0046823 | A1 | 3/2006 | Kaminkow et al. |
| 2006/0046830 | A1 | 3/2006 | Webb |
| 2006/0063584 | A1 | 3/2006 | Cregan |
| 2006/0068875 | A1 | 3/2006 | Cregan et al. |
| 2006/0073872 | A1 | 4/2006 | Jensen et al. |
| 2006/0073873 | A1 | 4/2006 | Rodgers et al. |
| 2006/0113729 | A1 | 6/2006 | Dodge |
| 2006/0135241 | A1 | 6/2006 | Wolf et al. |
| 2006/0170155 | A1 | 8/2006 | Silverman |
| 2006/0189364 | A1 | 8/2006 | Baerlocher |
| 2006/0205465 | A1 | 9/2006 | Dollof et al. |
| 2006/0237905 | A1 | 10/2006 | Nicely et al. |
| 2006/0246989 | A1 | 11/2006 | Glavich et al. |
| 2006/0252485 | A1 | 11/2006 | Baerlocher |
| 2007/0054721 | A1 | 3/2007 | Jackson |
| 2007/0060241 | A1 | 3/2007 | Low et al. |
| 2007/0066377 | A1 | 3/2007 | Van Asdale |
| 2007/0087811 | A1 | 4/2007 | Mayeroff |
| 2007/0120320 | A1 | 5/2007 | Miltenberger et al. |
| 2007/0135203 | A1 | 6/2007 | Nicely |
| 2007/0135204 | A1 | 6/2007 | Nicely |
| 2007/0149292 | A1 | 6/2007 | Kaminkow et al. |
| 2007/0167211 | A1 | 7/2007 | Rodgers et al. |
| 2007/0218982 | A1 | 9/2007 | Baerlocher |
| 2008/0020817 | A1 | 1/2008 | Kaminkow |
| 2008/0020842 | A1 | 1/2008 | Kaminkow |
| 2008/0051168 | A1 | 2/2008 | Kaminkow |
| 2008/0064462 | A1 | 3/2008 | Gerrard et al. |
| 2008/0070702 | A1 | 3/2008 | Kaminkow |
| 2008/0076532 | A1 | 3/2008 | Graham et al. |
| 2008/0090643 | A1 | 4/2008 | Kaminkow |
| 2008/0090647 | A1 | 4/2008 | Kaminkow |
| 2008/0102927 | A1 | 5/2008 | Mayeroff |
| 2008/0111309 | A1 | 5/2008 | Nicely et al. |
| 2008/0113704 | A1 | 5/2008 | Jackson |
| 2008/0113760 | A1 | 5/2008 | Baerlocher |
| 2008/0148542 | A1 | 6/2008 | Mayeroff |
| 2008/0167105 | A1 | 7/2008 | Kaminkow |
| 2008/0207299 | A1 | 8/2008 | Whitcher |
| 2009/0104962 | A1 | 4/2009 | Nicely et al. |
| 2009/0104978 | A1 | 4/2009 | Ben-Ami |
| 2009/0117959 | A1 | 5/2009 | Nicely |
| 2009/0121434 | A1 | 5/2009 | Baerlocher et al. |
| 2009/0124316 | A1 | 5/2009 | Baerlocher et al. |
| 2010/0004051 | A1 | 1/2010 | Walker et al. |
| 2010/0035676 | A1 | 2/2010 | Nicely et al. |
| 2010/0120484 | A1 | 5/2010 | Caputo et al. |
| 2010/0120500 | A1 | 5/2010 | Rodgers et al. |
| 2011/0130192 | A1 | 6/2011 | Englman et al. |

FOREIGN PATENT DOCUMENTS

| | | |
|---|---|---|
| EP | 0 945 837 | 9/1999 |
| GB | 2 170 938 | 8/1986 |
| GB | 2 333 880 | 8/1999 |
| WO | WO 97/32285 | 9/1997 |
| WO | WO 00/12186 | 3/2000 |
| WO | WO 2004/054670 | 7/2004 |
| WO | WO 2008/070055 | 6/2008 |

* cited by examiner

GAMING SYSTEM AND METHOD FOR PROVIDING A MULTIPLE SIDED CARD GAME

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Certain gaming machines enable players to play one or more card games. One such card game employed by gaming machines is a poker game. In one form of a poker game, the gaming machine initially deals a quantity of cards, such as five cards, all face up from a virtual deck of fifty-two cards to form an initial poker hand. After the player is provided the initial poker hand, the gaming machine enables the player to select one or more of the initially dealt playing cards to discard. For each playing card the player selected to discard, the gaming machine replaces that playing card with another playing card from the deck of cards. The initially held playing cards and any subsequently dealt replacement cards form a subsequent or final poker hand. After this replacement, the gaming machine evaluates the playing cards of the subsequent or final poker hand to determine if the subsequent or final poker hand is a winning poker hand. The gaming machine then provides the player an award based on any winning poker hand.

In another form, the poker game includes multiple hands of poker played simultaneously. In this poker game, the gaming machine deals the player at least two hands of cards. The player chooses the cards to hold in a primary hand and the gaming machine holds such held cards in the primary hand and the other hands of cards. The gaming machines removes the remaining non-held cards from each hand displayed. For each hand, the gaming machine randomly deals replacement cards into that hand. Since the replacement cards are randomly dealt independently for each hand, the replacement cards for each hand may be different. After this replacement, for each hand, the gaming machine evaluates the cards for winning poker hands and provides any awards associated with any winning poker hands.

Gaming machines which employ card games provide excitement and enjoyment for certain players. Accordingly, a continuing need exists to enable players to play new and different card games.

SUMMARY

The present disclosure relates generally to gaming systems and methods for providing a card game that employs multiple-sided or multi-sided playing cards.

In various embodiments, the gaming system enables a player to play one or more games which utilize one or more sets or decks of multiple-sided playing cards. In such embodiments, a first side or face of each multiple-sided playing card is associated with one of a plurality of playing cards from a first set or deck of playing cards for a first game and a second side or face of each multiple-sided playing card is associated with one of a plurality of playing cards from a second, different set or deck of playing cards for a second, different game. Put differently, one side of each playing card is associated with or otherwise corresponds to one or more game elements for one game and another side of each playing card is associated with or otherwise corresponds to one or more game elements for another game. Accordingly, multiple sides of each dealt playing card are utilized in separate plays of separate games.

In operation of various embodiments, the multiple-sided playing cards include double-sided playing cards wherein if a double-sided card game triggering event occurs, the gaming system deals a plurality of double-sided playing cards. In one such embodiment, the two sides of the double-sided playing card are linked prior to the deal such that each double-sided playing card includes a first predetermined playing card (for a first card game) displayed on one side of the double-sided playing card and a second predetermined playing card (for a second card game) displayed on the other side of the double-sided playing card. In another such embodiment, the gaming system independently randomly determines the playing cards for each side of the double-sided playing card. In this embodiment, the gaming system randomly determines a first playing card (for a first card game) to display on one side of the double-sided playing card and also randomly determines a second playing card (for a first second game) to display on the other side of the double-sided playing card.

In certain embodiments, the quantity of double-sided playing cards dealt is less than the quantity of playing cards required to complete any playing card hands and thus the plurality of double-sided playing cards form two partial playing card hands for the two games associated with the double-sided playing cards. In these embodiments, since one side of each double-sided playing card is associated with a first game and another side of each double-sided playing card is associated with a second game, by dealing a designated quantity of such double-sided playing cards, the gaming system deals a first partial hand associated with the first game and further deals a second partial hand associated with the second game.

In certain embodiments, for one, more or each of the dealt double-sided playing cards, the gaming system displays both sides of that double-sided playing card. For example, if one side of a first dealt double-sided playing card includes a first playing card from a first set of playing cards for a first game and if another side of the first dealt double-sided playing card includes a first playing card from a second set of playing cards for a second game, the gaming system displays (either simultaneously, overlappingly or sequentially) the first playing card from the first set of playing cards for the first game and the first playing card from the second set of playing cards for the second game. Such a configuration enables the player to simultaneously or sequentially view both partial playing card hands in association with a single plurality of dealt double-sided playing cards.

After using the same plurality of displayed double-sided playing cards to display two partial playing card hands, the gaming system enables the player to pick or select which of the two playing card hands to play to completion. That is, after displaying at least a partial result of each of the two games associated with the two sides of the dealt double-sided playing cards, the gaming system enables the player to pick which of the two games to play using the respective partial result for that game. Such player selection provides an increased sense of involvement and thus an increased amount of excitement and entertainment for certain players.

Following the player's selection of one of the plurality of playing card hands, the gaming system deals any remaining playing cards necessary to form at least one complete playing card hand. In certain embodiments, for one, more or each of the subsequently dealt playing cards, the gaming system displays both sides of any dealt double-sided playing card. In other words, for both the player-picked partial hand to complete and the unpicked partial hand, the gaming system displays the subsequently dealt playing cards and thus displays each completed playing card hand. Such a configuration enables the player to view the results of both the selected hand of playing cards which the player decided to play and the unselected hand of playing cards which the player decided not to play.

In one embodiment, the formed completed playing card hand is a final playing card hand which the gaming system evaluates for any associated awards. In another embodiment, following the formation of a completed playing card hand, the gaming system enables the player to select which playing cards of the selected playing card hand to discard. Following such discard, the gaming system deals a replacement playing card for each discarded playing card to form a final playing card hand which the gaming system evaluates for any associated awards.

After the determination of a final playing card hand for at least the selected playing card hand, the gaming system determines, according to the paytable associated with the game the player selected to play, any awards for the determined final playing card hand. Such a gaming system thus provides certain players with an increased amount of excitement and entertainment as these player's view, in association with a single group of multiple-sided playing cards, a plurality of partial playing card hands for a plurality of different games and these player's subsequently select which of the plurality of partial playing card hands to play to completion. That is, the gaming system provides additional excitement and entertainment for certain players in having to make the interesting decision of which playing card hand to play in addition to the other decisions, such as the poker play decisions, associated with the play of the selected game.

Additional features and advantages are described in, and will be apparent from, the following Detailed Description and the figures.

DETAILED DESCRIPTION

Double Sided Card Game

In various embodiments, the present disclosure generally relates to gaming systems and methods for providing a card game which utilizes multiple-sided playing cards to simultaneously form a plurality of playing card hands and further enables a player to pick which of the partially formed playing card hands to play to completion.

While the embodiments described below are directed to a primary wagering game, it should be appreciated that the present disclosure may additionally or alternatively be employed in association with a secondary game. Moreover, while the player's credit balance, the player's wager, and any awards are displayed as an amount of monetary credits or currency in certain of the embodiments described below, one or more of such players credit balance, such player's wager, and any awards provided to such a player may be for non-monetary credits, promotional credits, and/or player tracking points or credits.

Figure 1:
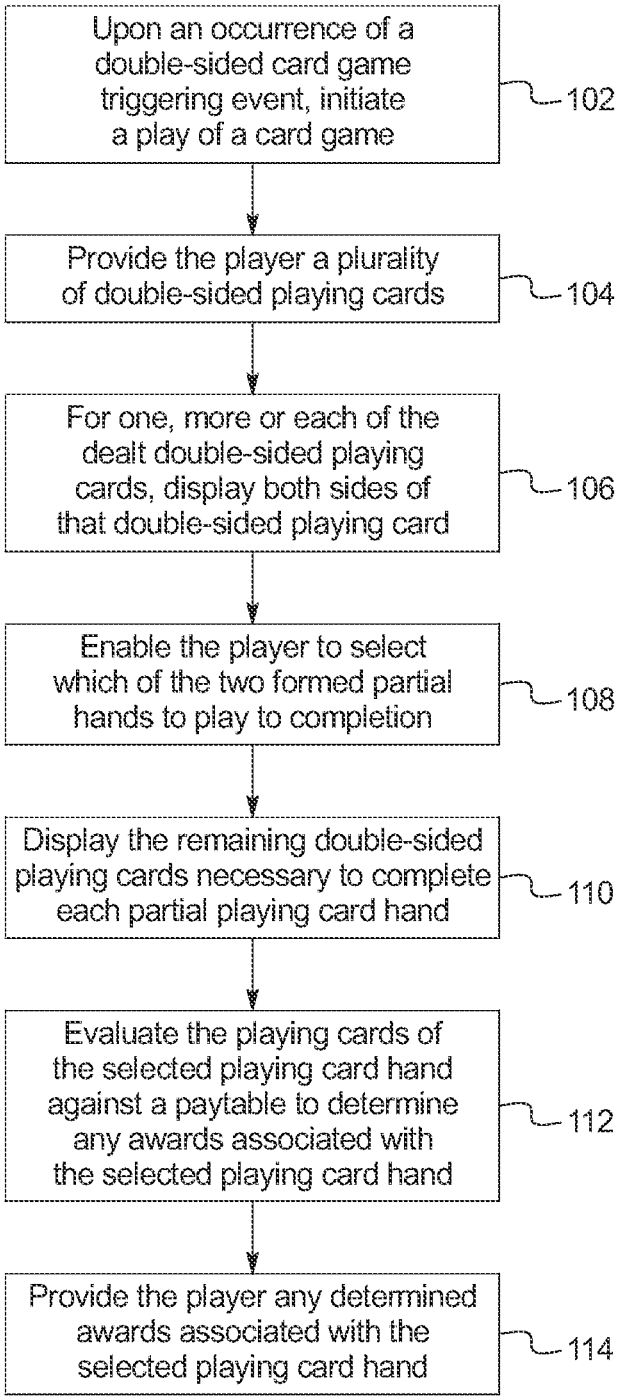
FIG. 1 is a flow chart an example process for operating a gaming system providing one embodiment of the multiple sided card game disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, the multiple-sided playing cards disclosed herein include double-sided playing cards wherein upon an occurrence of a double-sided card game triggering event, the gaming system initiates a play of a card game as indicated in block 102 of FIG. 1. In one embodiment, the playing card game is a primary game or base game wherein a double-sided card game triggering event occurs if the player places a primary playing card game wager to play the playing card game. In another embodiment, the playing card game is a secondary or bonus game wherein a double-sided card game triggering event occurs based on a displayed event associated with a wagered on play of a primary game.

In another embodiment, the playing card game is a secondary or bonus game wherein a double-sided card game triggering event occurs based on an event independent of any displayed event associated with a wagered on play of a primary game.

Figure 2A:
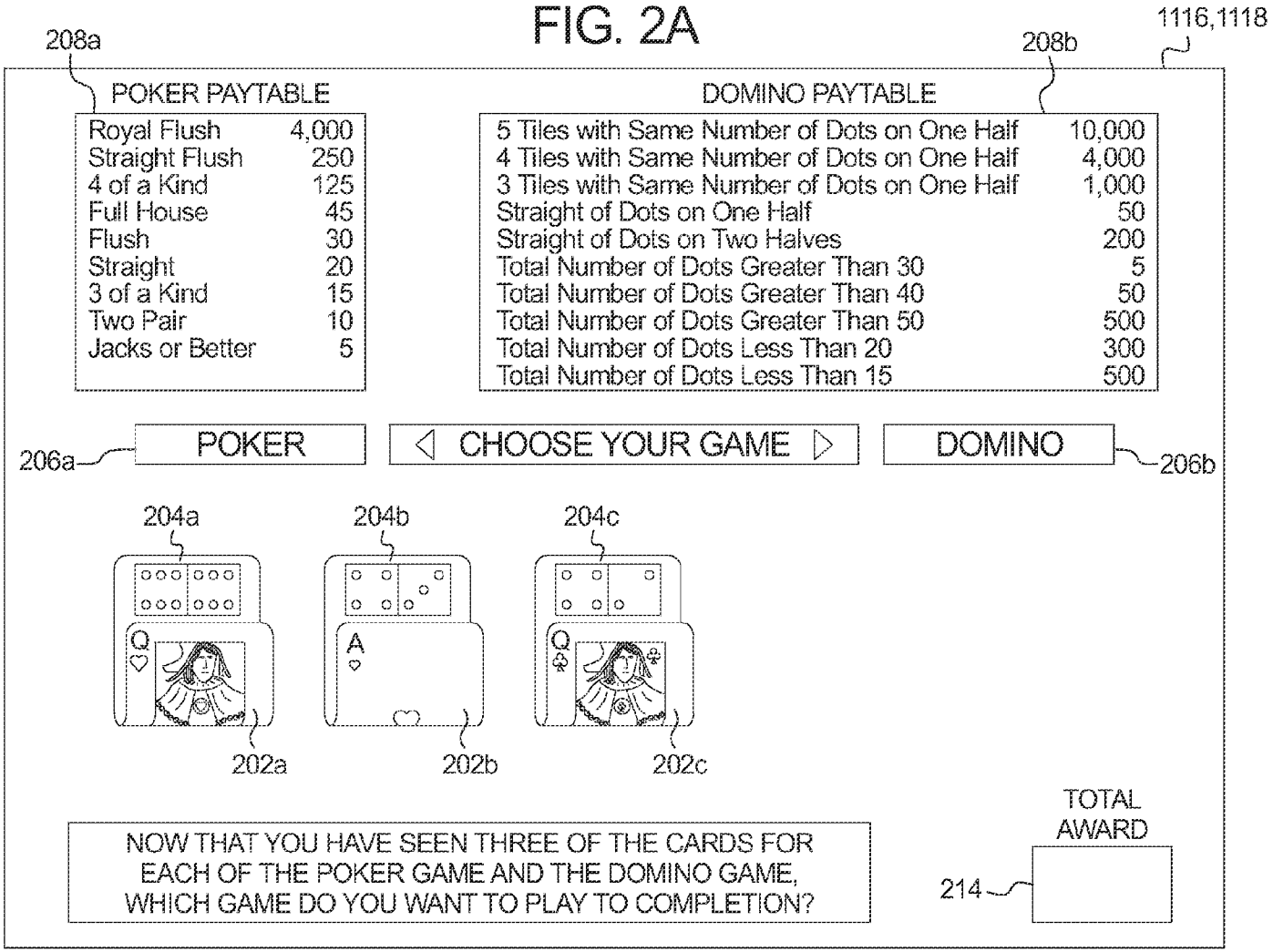
FIGS. 2A, 2B, 2C and 2D are front views of one embodiment of the gaming system disclosed herein illustrating a play of game which employs double-sided playing cards.

Following the initiation of the playing card game, the gaming system deals, selects or provides the player a plurality of double-sided playing cards as indicated in block 104. In one embodiment, each side of each of the provided double-sided playing card is associated with a separate set or deck of playing cards for a separate game played. That is, a first side of each provided double-sided playing card is associated with one of a plurality of playing cards from a first set or deck of playing cards for a first game and a second side of each provided double-sided playing card is associated with one of a plurality of playing cards from a second, different set or deck of playing cards for a second, different game. For example, as seen in FIG. 2A, the gaming system deals the player three double-sided playing cards, wherein: (i) a first double-sided playing card includes the queen of hearts playing card 202*a* on one side and a six dot—six dot domino playing card 204*a* on another side, (ii) a second double-sided playing card includes the ace of heart playing card 202*b* on one side and a four dot—three dot domino playing card 204*b* on another side, and (iii) a third double sided playing card includes the queen of clubs playing card 202*c* on one side and a four dot—two dot domino playing card 204*c* on another side. As seen in this example, one side of each dealt double-sided playing card is associated with a poker game and another side of each dealt double-sided playing card is associated with a domino game.

In one embodiment, for one, more or each of the dealt double-sided playing cards, the gaming system displays both sides of that double-sided playing card as indicated in block 106 of FIG. 1. In another embodiment, for one, more or each of the dealt double-sided playing cards, the gaming system displays one of the sides of that double-sided playing card and further masks (or otherwise does not display) another one of the sides of that double-sided playing card. In different embodiments, the gaming system displays a rank, a rank and a suit, or any defining characteristics or indicia of each side of one or more dealt double sided playing card. Such a configuration enables the player to simultaneously, overlappingly or sequentially view one or more playing cards of one or more playing card hands in association with a single plurality of dealt double-sided playing cards. In another embodiment, for one, more or each of the dealt double-sided playing cards, the gaming system masks (or otherwise does not display) both sides of that double-sided playing card.

In one embodiment, the quantity of double-sided playing cards dealt and displayed to the player is less than the quantity of playing cards necessary to form any complete playing card hands. In this embodiment, the playing cards dealt and displayed to the player form two partial playing card hands for the two games associated with the double-sided playing cards. Put differently, since one side of each playing card is associated with a first game and another side of each playing card is associated with a second game, by displaying a plurality of such double-sided playing cards, the gaming system displays a first partial hand associated with the first game and further displays a second partial hand associated with the second game. For example, as seen in FIG. 2A, the three double-sided playing cards dealt form a first partial playing card hand for a play of the poker game and also form a second partial playing card hand for a play of the domino game.

In one embodiment, the gaming system deals the double-sided playing cards from a single fifty-two double-sided playing card deck. In another embodiment, the gaming system deals the double-sided playing cards from a plurality of fifty-two double-sided playing card decks. In these embodiments, the two sides of the double-sided playing card are linked prior to the deal such that each double-sided playing card includes a first predetermined playing card displayed on one side of the double-sided playing card and a second predetermined playing card displayed on the other side of the double-sided playing card. In another embodiment, the gaming system selects the double-sided playing cards from a predetermined set of double-sided playing cards. In another embodiment, the gaming system selects the double-sided playing cards from a deck of more than fifty-two double-sided playing cards, such as a deck including one or more "joker" or wild playing cards. In this embodiment, a joker or wild playing card may substitute for any other playing card.

In another embodiment, the gaming system independently randomly determines the playing cards for each side of the double-sided playing card. In this embodiment, the gaming system randomly determines a first playing card to display on one side of the double-sided playing card and also randomly determines a second playing card to display on the other side of the double-sided playing card. This embodiment provides an increased amount of volatility because each playing card displayed on each side of each double-sided playing card is randomly determined each time such playing cards are dealt.

In one embodiment, after the gaming system deals the plurality of double-sided playing cards to form two partial hands, the gaming system enables the player to pick or select which of the two formed partial hands to play to completion as indicated in block 108. For example, as seen in FIG. 2A, the gaming system enables the player to select either a play of the poker game 206*a* or a play of the domino game 206*b*. In this example, the gaming system displays appropriate messages such as "NOW THAT YOU HAVE SEEN THREE OF THE CARDS FOR EACH OF THE POKER GAME AND THE DOMINO GAME, WHICH GAME DO YOU WANT TO PLAY TO COMPLETION?" to the player visually, or through suitable audio or audiovisual displays.

It should be appreciated that enabling the player to pick which game to play enables a gaming system operator to combine two relatively lower average expected payout paytables and combine them to form a relatively higher average expected payout paytable. That is, since the gaming system enables the player to pick the higher paying of the two playing card hands, the payout for the player is higher than when either of the two paytables for the two individual playing card hands are played individually.

Figure 2B:
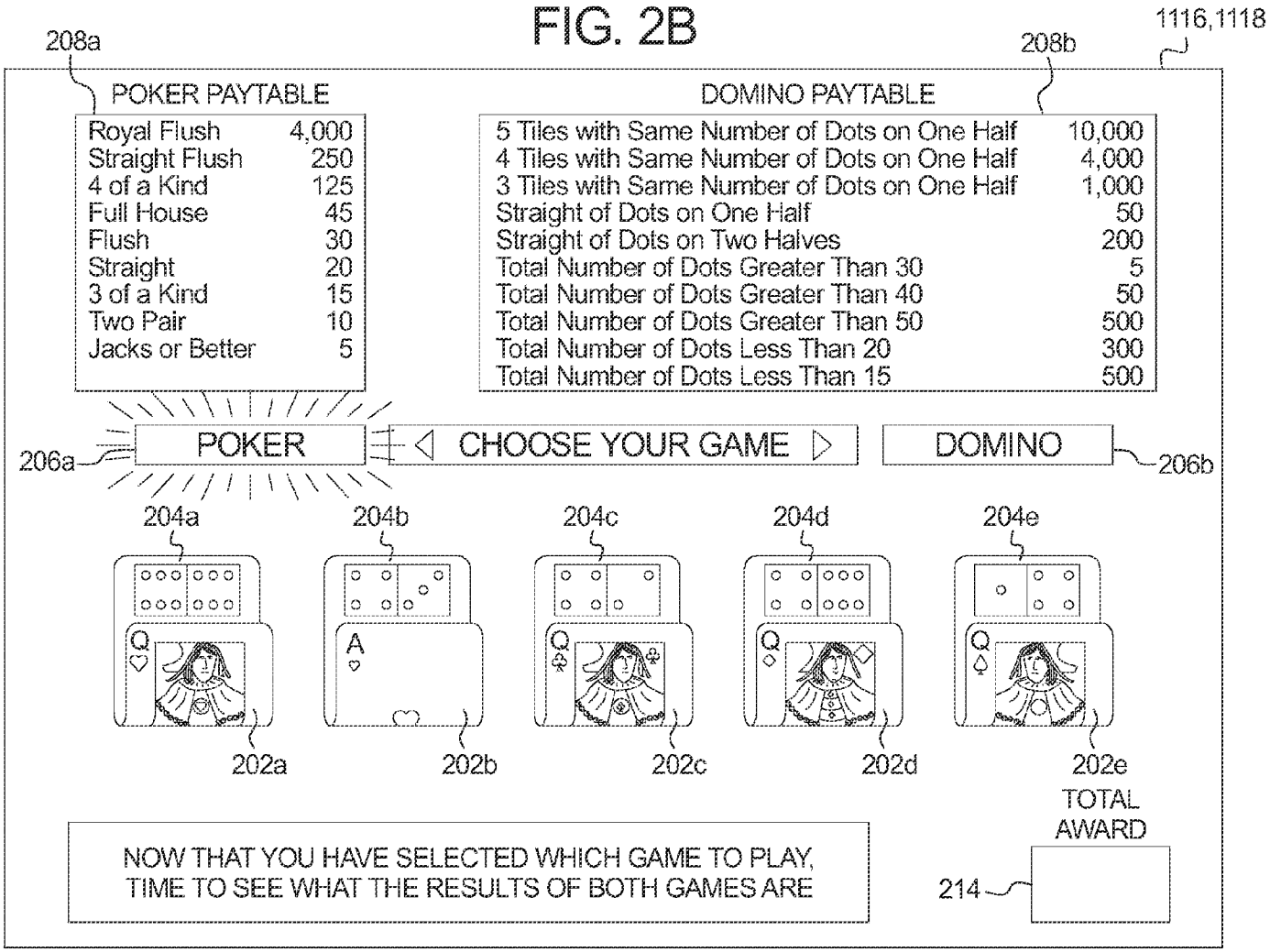
Figure 2C:
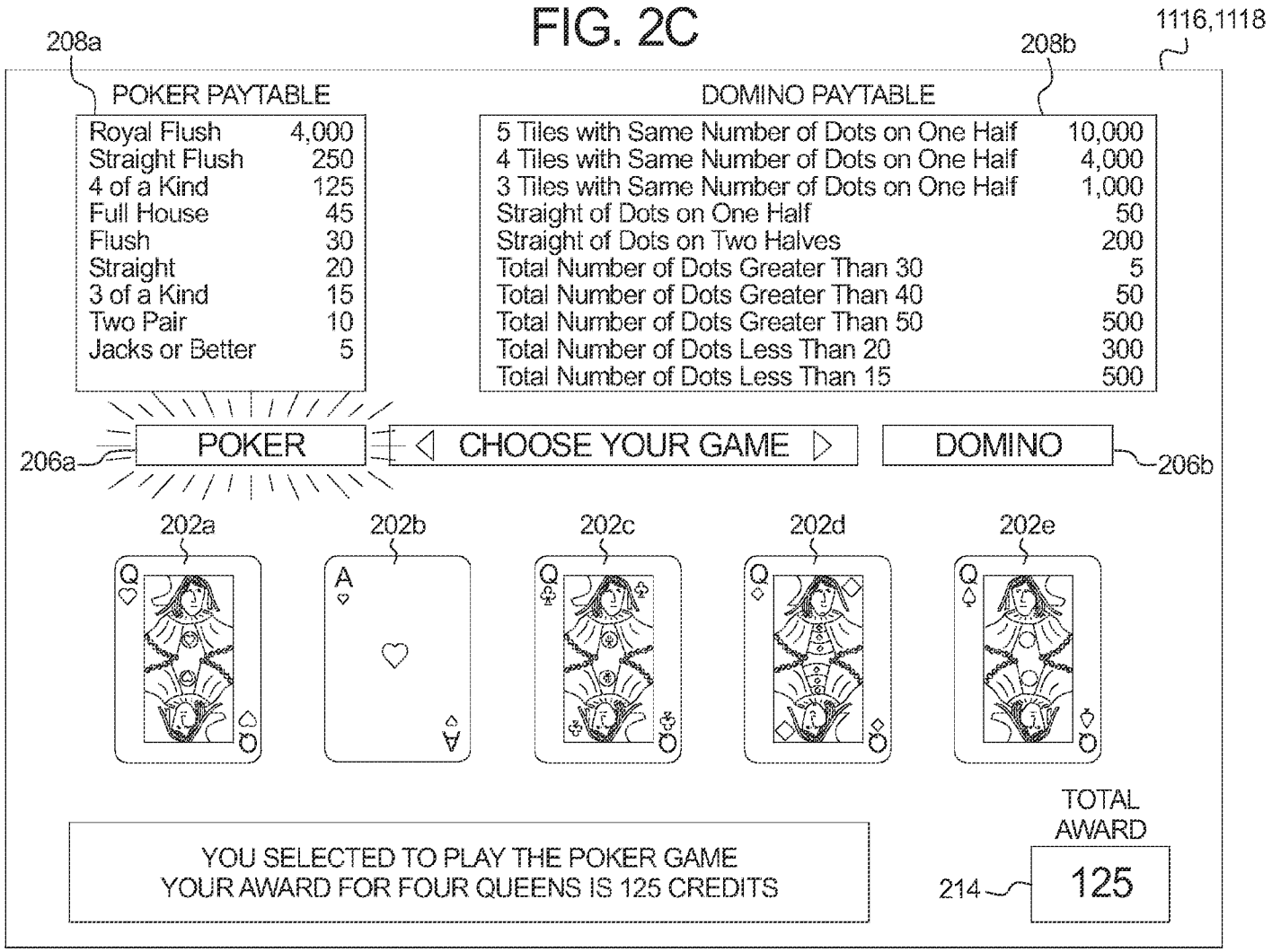

After enabling the player to select which of the two games associated with the two sides of the dealt double-sided playing cards to play to completion, the gaming system displays the remaining double-sided playing cards necessary to complete each partial playing card hand as indicated in block 110 of FIG. 1. In this embodiment, regardless of which game the player selected to play, the gaming system displays to the player the results of both the player's selected game and the game the player did not select to play. Such a configuration provides an increased amount of excitement and enjoyment for certain players as these players view both what they win and what they could have won. For example, as seen in FIG. 2B, the gaming system displays two doubled-sided playing cards to complete both partial playing card hands. In this example, for the play of the poker game, one side of one of the two dealt double-sided playing cards includes the queen of diamonds playing card 202*d* and one side of the other of the two dealt double-sided playing cards includes the queen of spades playing card 202*e*. As further seen in FIG. 2B, for the play of the domino game, one side of one of the two dealt double-sided playing cards includes a four dot—six dot domino playing card 204*d* and one side of the other of the two dealt double-sided playing cards includes a one dot—four dot domino playing card 204*e*, In this example, the gaming system displays appropriate messages such as "NOW THAT YOU HAVE SELECTED WHICH GAME TO PLAY, TIME SEE WHAT THE RESULTS OF BOTH GAMES ARE" to the player visually, or through suitable audio or audiovisual displays.

Following the selection of one of the games associated with one of the two sides of the dealt double-sided playing cards, the gaming system evaluates the playing cards of the selected playing card hand against a paytable to determine any awards associated with the selected playing card hand as indicated in block 112 of FIG. 1. The gaming system then provides the player any determined awards associated with the selected playing card hand as indicated in block 114.

For example, as seen in FIG. 20, if the player selected to play the poker game associated with one of the sides of the dealt double-sided playing cards, the gaming system utilizes poker paytable 208*a* to determine that the player's poker hand of four-of-a-kind (i.e., four playing cards each having the same rank of queen) is a winning poker hand associated with an award of one-hundred-twenty-five credits (indicated in award meter 210) which the gaming system provides to the player. In this example, the gaming system displays appropriate messages such as "YOU SELECTED TO PLAY THE POKER GAME" and "YOUR AWARD FOR FOUR QUEENS IS 125 CREDITS" to the player visually, or through suitable audio or audiovisual displays.

Figure 2D:
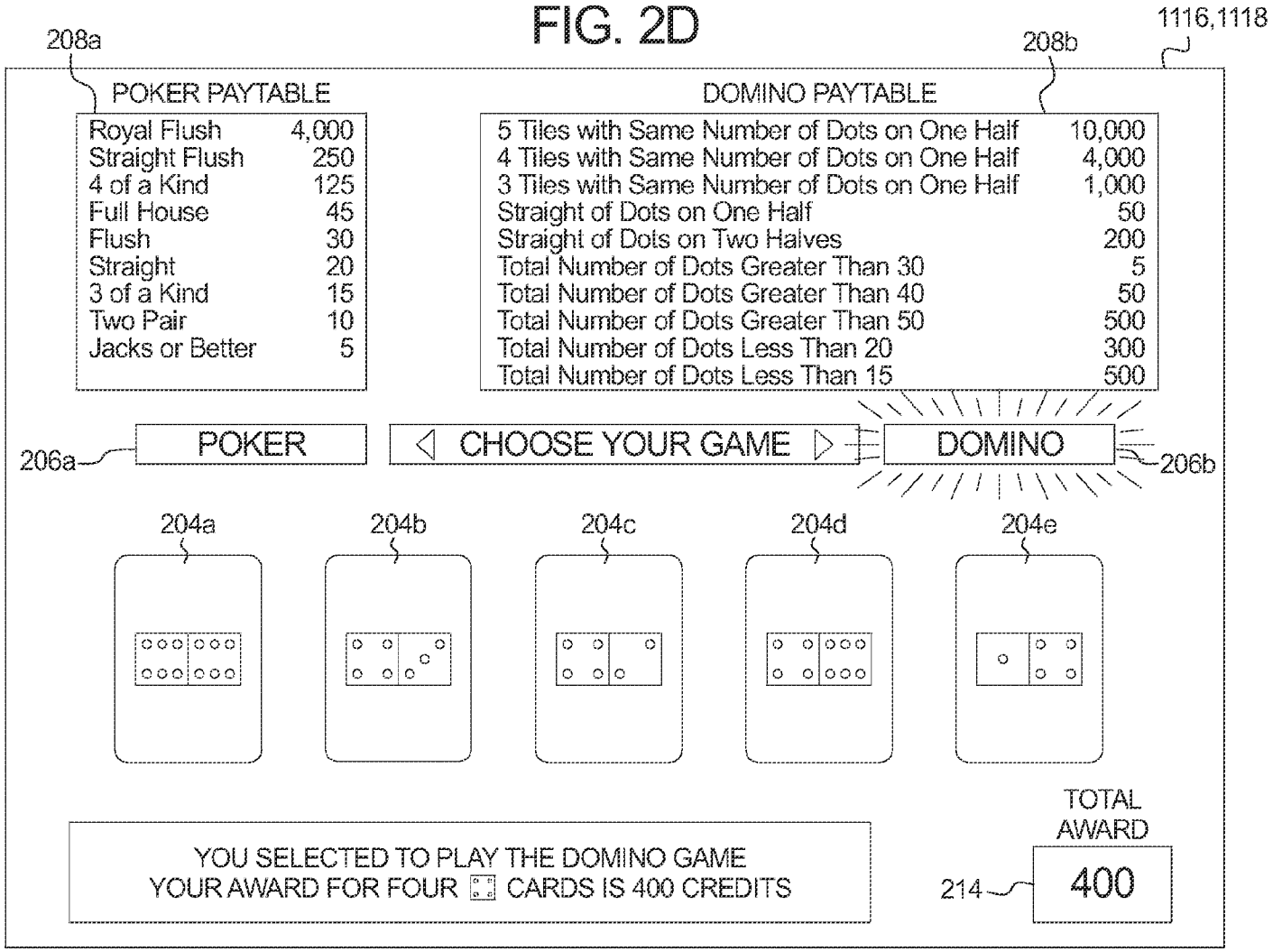

In another example, as seen in FIG. 2D, if the player selected to play the domino game associated with one of the sides of the dealt double-sided playing cards, the gaming system utilizes domino paytable 208*b* to determine that the player's domino hand of four playing cards with the same number of dots on one end of each playing card (i.e., the four playing cards with four dots on one end) is a winning domino hand associated with an award of four-hundred credits (indicated in award meter 210) which the gaming system provides to the player. In this example, the gaming system displays appropriate messages such as "YOU SELECTED TO PLAY THE DOMINO GAME" and "YOUR AWARD FOR FOUR 4 DOT CARDS IS 400 CREDITS" to the player visually, or through suitable audio or audiovisual displays.

In one embodiment, one or more of the games played utilizing the double-sided playing cards include one or more draw features. In certain of these embodiments, following the selection of which game to play and the dealing of the plurality of double-sided playing cards to complete each partial hand of playing cards, the gaming system enables the player to select zero, one or more of the playing cards in the selected playing card hand to hold. In this embodiment, after enabling the player to indicate which playing cards to hold, for each non-held or discarded playing card, the gaming system provides or deals the player a new playing card to replace the non-held or discarded playing card. The held playing cards and any replacement playing cards form a draw playing card hand which is evaluated against a paytable for any associated awards as described above.

In one embodiment employing a draw feature, one or more replacement playing cards are double-sided playing cards. In this embodiment, such double-sided replacement playing cards affect the card hand the player selected to play and the card hand the player did not select to play (which may increase the excitement for certain players to see any modifications of the non-selected card hand). In another embodiment employing a draw feature, one or more replacement playing cards are single-sided playing cards.

In another embodiment employing a draw feature, one of the two games played using double-sided playing cards enables the player to discard one or more playing cards while the other of the two games played using double-sided playing cards does not enable any discarding of any playing cards.

In one embodiment, as described above, the playing cards associated with the two sides of the double-sided playing cards are associated with different games. For example, the game associated with a first side of the double-sided playing cards provides the player with the ability to hold and replace cards as in draw video poker whereas the second side of the double-sided playing cards provides a stud game without any replacement ability. In another embodiment, the playing cards associated with the two sides of the double-sided playing cards are associated with variations of the same game. For example, one side of a double-sided playing card is associated with a play of a poker game with joker playing cards and the other side of the double-sided playing card is associated with a play of a poker game without joker playing cards. In another embodiment, the playing cards associated with the two sides of the double-sided playing cards are associated with the same game. For example, one side of a double-sided playing card is associated with a play of a poker game using a first deck and the other side of the double-sided playing card is associated with a play of the same poker game using a second, independent deck.

In another embodiment, the quantity of double-sided playing cards dealt and displayed to the player equals the quantity of playing cards necessary to form a complete playing card hand. In this embodiment, the playing cards dealt and displayed to the player form two complete playing card hands for the two games associated with the double-sided playing cards. In another embodiment, the quantity of double-sided playing cards dealt and displayed to the player is greater than the quantity of playing cards necessary to form a complete playing card hand. In one such embodiment, the gaming system selects which of the playing cards will form the complete playing card hands for the two games associated with the double-sided playing cards. In another such embodiment, the gaming system enables the player to select which of the playing cards will form the complete playing card hands for the two games associated with the double-sided playing cards.

In another embodiment, the gaming system displays one or more double-sided playing cards in conjunction with displaying one or more single-sided playing cards such that at least one complete hand is formed for at least one of the games played in association with the double-sided playing cards and at least one partial hand is formed for at least one of the games played in association with the double-sided playing cards.

In one embodiment, the gaming system enables the player to place an additional bet or side wager when the player selects which game to play. This embodiment enables a player to see one or more partial results of one or more games associated with the double-sided playing cards and then place an additional wager based on these partial results. In another embodiment, the gaming system requires the player to place an additional bet or side wager to enable the player to select which game to play. In another embodiment, the gaming system enables the player to modify the player's wager, such as double the player's wager, and play both playing card hands (associated with both sides of the double-sided playing cards) to completion. In another embodiment, after displaying one or more partial results of one or more games associated with the double-sided playing cards, the gaming system enables the player to surrender the partial playing card hands. In this embodiment, the gaming system forfeits the player's play of the current game and returns a portion of the player's initial wager back to the player.

In one embodiment, each of the games played utilizing the double-sided playing cards employ the same quantity of playing cards to form a complete playing card hand. For example, as seen in FIGS. 2A to 2D, the stud poker game and the domino game both have five playing cards in the respective completed playing card hand for both games. In another embodiment, two or more of the games played utilizing the double-sided playing cards employ different quantities of playing cards to form complete playing card hands.

In different embodiments, the playing cards associated with one or more sides of the double-sided playing cards include, but are not limited to: poker playing cards, blackjack playing cards, Uno playing cards, Tarot playing cards, Mahjong playing cards, any sports cards, such as any baseball cards or football cards, any playing cards associated with any known card game, dice faces, domino tiles or playing cards, Pai Gow tiles or playing cards, any playing cards associated with any known board game, such as Monopoly® cards, Magic the Gathering playing cards, Dungeons and Dragons playing cards, Pokémon® cards, playing cards including slot symbols, playing cards associated with one or more dice, and any suitable playing card.

In another embodiment, the gaming system employs multiple, simultaneous deals of double-sided playing cards. In this embodiment, since each deal of one or more double-sided playing cards is associated with two different plays of two games (i.e., each side or face of each double-sided playing card is a separate playing card for a separate game), a plurality of sets of double-sided playing cards represents a plurality of plays of a plurality of different card games.

In different embodiments, in addition to employing double-sided playing cards with a five-card poker game (as seen in FIGS. 2A to 2D), the gaming system employs double-sided playing cards in association with other suitable types of poker games, such as Texas Hold'em, as well as other suitable non-poker interactive cards games, such as blackjack. In different embodiments, the playing cards associated with one or more sides of the double-sided playing cards include, but are not limited to playing cards associated with a play of any suitable card game, a play of any suitable slot game, a play of any suitable wheel game, a play of any suitable offer and acceptance game, a play of any suitable award ladder game, a play of any suitable puzzle-type game, a play of any suitable persistence game, a play of any suitable selection game, a play of any suitable cascading symbols game, a play of any suitable ways to win game, a play of any suitable scatter pay game, a play of any suitable coin-pusher game, a play of any suitable elimination game, a play of any suitable stacked wilds game, a play of any suitable trail game, a play of any suitable bingo game, a play of any suitable video scratch-off game, a play of any suitable pick-until-complete game, a play of any suitable shooting simulation game, a play of any suitable racing game, a play of any suitable promotional game, a play of any suitable high-low game, a play of any suitable lottery game, a play of any suitable number selection game, a play of any suitable dice game, a play of any suitable skill game, a play of any suitable auction game, a play of any suitable reverse-auction game, a play of any suitable group game or a play of any other suitable type of game. Accordingly, any suitable interactive card game which includes one or more double-sided playing cards may be implemented in accordance with the present disclosure.

In another embodiment, the gaming system enables the player to reallocate the playing cards of the double-sided playing cards amongst different hands of playing cards. In this embodiment, the gaming system deals a plurality of double-sided playing cards to the player. The gaming system then enables the player to select which playing cards (of the double-sided playing cards) are to be associated with a first hand for a first game and which playing cards (of the double-sided playing cards) are to be associated with a second hand of a second game. Following the player's selection, the gaming system discards any non-selected or non-allocated playing cards and proceeds to evaluate the first and second hands against paytables for the first and second games, respectively.

In another embodiment, the gaming system initially deals and masks the plurality of double-sided playing cards. In this embodiment, the gaming system enables the player to reveal one of the playing cards of one of the double-sided playing cards or to select one the two games associated with the double-sided playing cards to play. If the player picks one of the two games to play, the gaming system proceeds with the play of the selected game according to a first paytable for that game. If the player selects to reveal one of the playing cards of one of the double-sided playing cards, the gaming systems displays such playing card, modifies the paytables for the two games and again enables the player to reveal one of the playing cards of one of the double-sided playing cards or to select one the two games associated with the double-sided playing cards to play. This process continues until the player selects a game to play or until each of the playing cards of the double-sided playing cards are displayed (at which time the player selects a game to play). In one such embodiment, for each additional playing card revealed, the gaming system modifies the paytables to a less lucrative paytable such that the sooner the player picks a game to play, the more lucrative the paytable associated with the selected play of that game.

While the playing cards disclosed herein are referred to as double-sided playing cards, any quantity of multi-sided playing cards, such as three-sided playing cards or four-sided playing cards, may be employed in association with the present disclosure. In one embodiment, the gaming system displays each multi-sided playing card as a three-dimensional object with a quantity of sides wherein each side is associated with a different playing card from a different set of playing cards for a different game. For example, the gaming system displays a six-sided cube wherein each of the six sides is associated with a different playing card from a different game. It should be appreciated that any suitable shape, such as a cube, pyramid, polygonal solids or irregular solids may be used as a multi-sided playing card.

In one embodiment employing any quantity of multi-sided playing cards, the gaming system enables the player to select a plurality, but less than all, of the partial hands to play to completion. In another embodiment employing any quantity of multi-sided playing cards, the gaming system enables the player to select each of the partial hands to play to completion.

In different embodiments, the award provided in association with the complete playing card hand are associated with or otherwise correspond to one or more of: credit amounts, modifiers (e.g., multipliers), physical prizes, free spins, progressive awards, values, virtual goods associated with the gaming system, virtual goods not associated with the gaming system.

In another embodiment, to comply with certain jurisdictional requirements that the random computer selection be delayed as long as possible, the gaming system: (i) enables the player to make a wager and press a deal or play button, (ii) randomly selects three playing card fronts and three playing card backs, (iii) enables the player to select which game to play, (iv) randomly selects two more playing card fronts and two more playing card backs, (v) enables the player to select which playing cards to hold, and (vi) randomly selects a replacement playing card for each discarded (i.e., non held) playing card.

Alternative Embodiments

It should be appreciated that in different embodiments, one or more of:

i. a quantity of double-sided playing cards to be initially dealt;
ii. a quantity of playing cards of the dealt double-sided playing cards to be initially displayed to the player;
iii. a paytable to employ in association with each of the games of the double-sided playing cards;
iv. a determination of whether to display the complete hand of the playing card hand of the non-selected game;
v. a determination of whether to enable a draw feature;
vi. a determination of whether to enable any side wagering on any of the games of the double-sided playing cards; and
vii. any determination disclosed herein;

is/are predetermined, randomly determined, randomly determined based on one or more weighted percentages, determined based on a generated symbol or symbol combination, determined based on a random determination by the central controller, determined based on a random determination at the gaming system, determined based on at least one play of at least one game, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
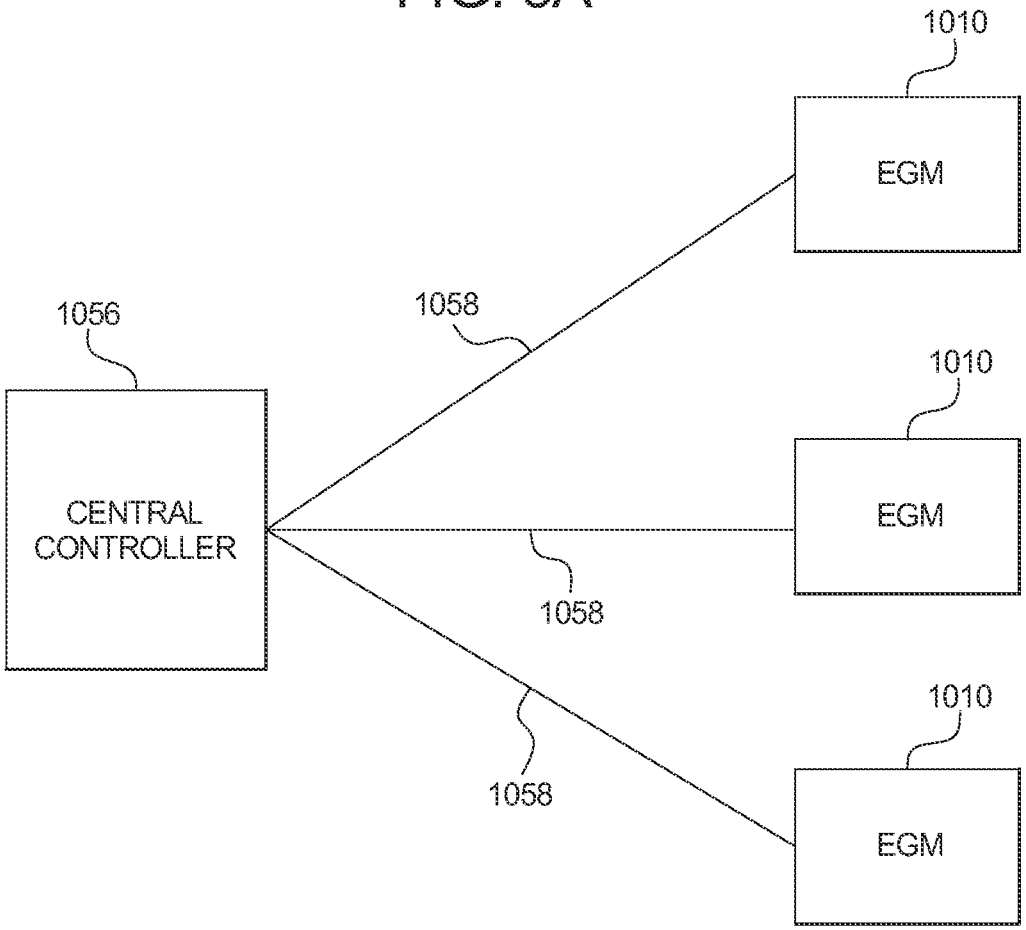
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 33 illustrates an example EGM including a processor 1012.

Figure 3B:
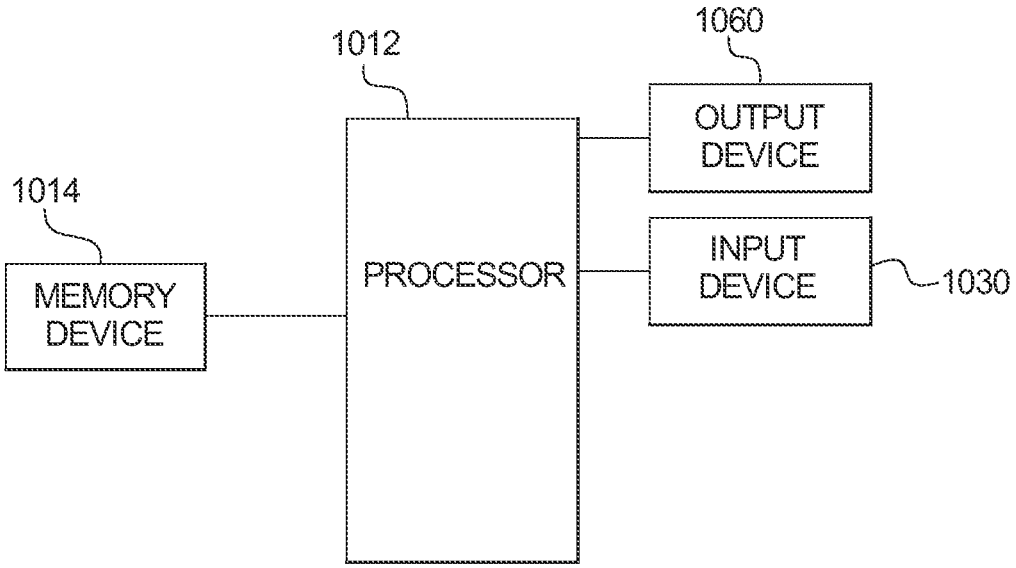
FIG. 3B is a schematic block diagram of one embodiment of an electronic configuration of the gaming system disclosed herein.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
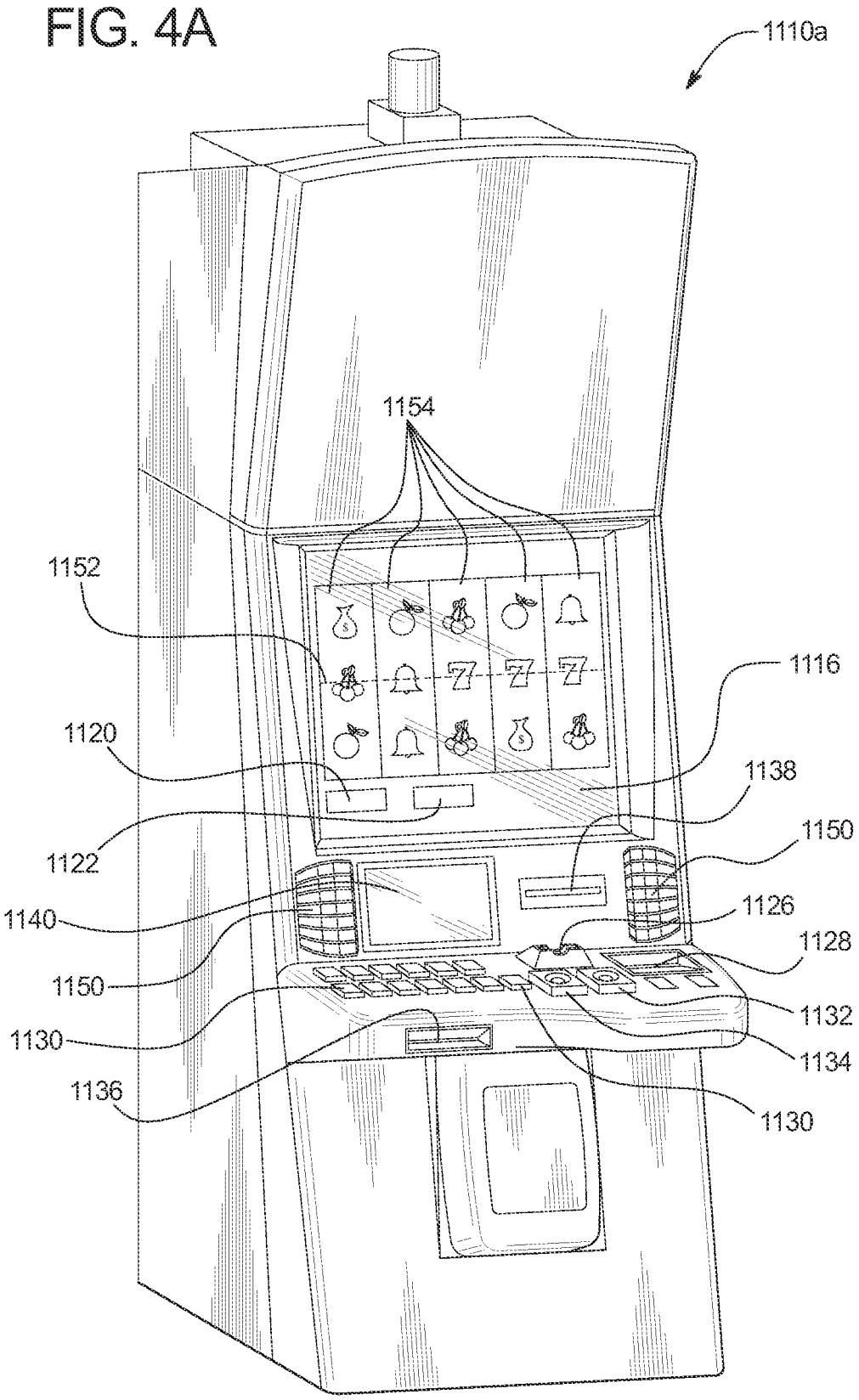
FIGS. 4A and 4B are perspective views of example alternative embodiments of the gaming system disclosed herein.
Figure 4B:
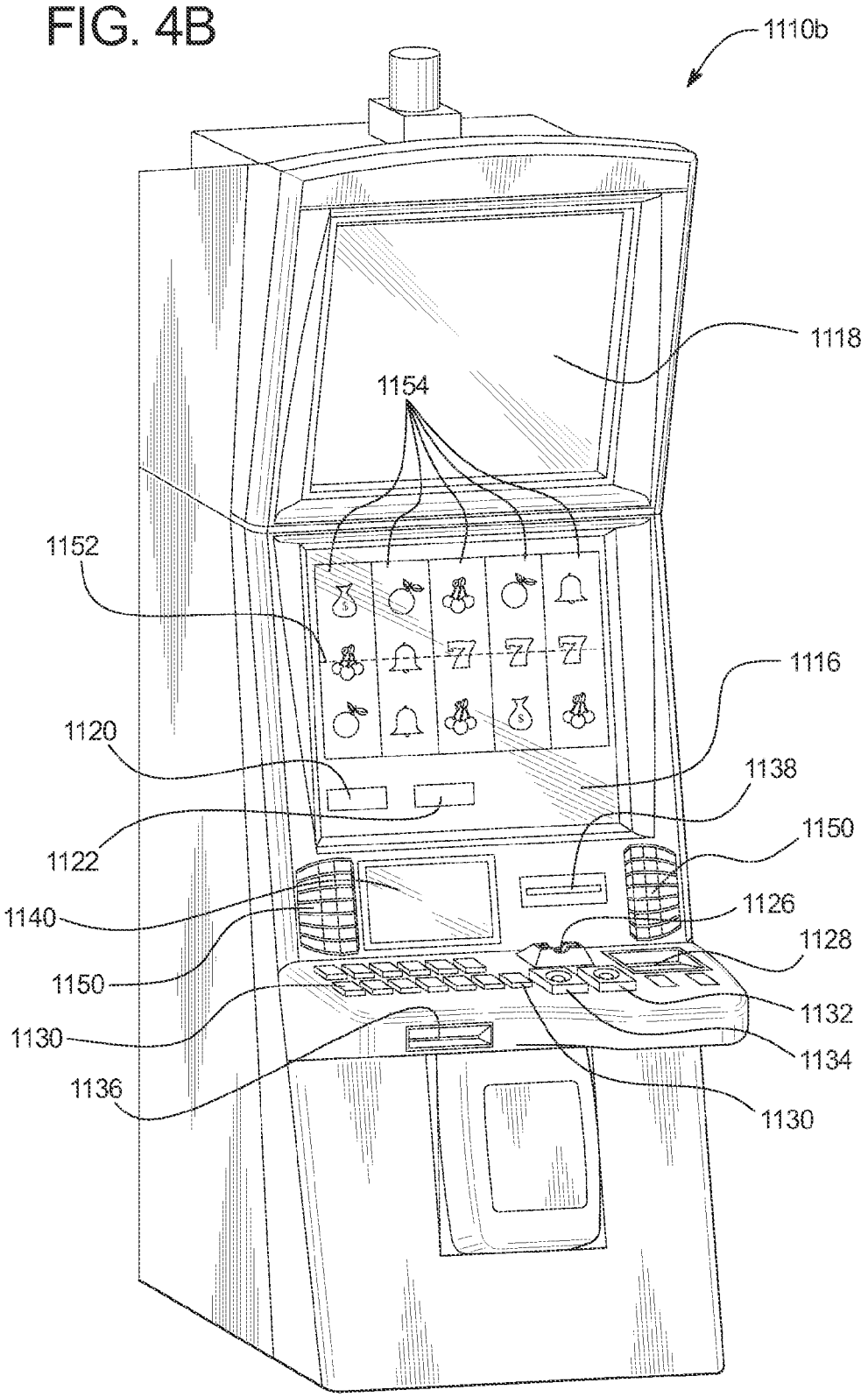

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting.

In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by; (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) (if the poker game disclosed herein is implemented as a secondary game) and the secondary game(s) (if the poker game disclosed herein is implemented as a primary game) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the poker game disclosed herein is a bonus game, the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 200810020846, 2009/0123364, 2009/0123363, and 2010/0227677 describe various examples of different progressive gaming systems.

As generally noted above, in certain embodiments wherein the poker game disclosed herein is a bonus game, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including:

(i) an acceptor, and (ii) a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor establish a credit balance based, at least in part, on a monetary value associated with the received physical item, wherein said physical item is selected from the group consisting of: a ticket associated with the monetary value and a unit of currency, (b) select, via the at least one processor, at least one multi-sided playing card, each multi-sided playing card having at least:

(i) a first side associated with one of a plurality of first playing cards of a first game, and (ii) a second side associated with one of a plurality of second playing cards of a second, different game, (c) display, via the at least one display device, at least:

(i) a first partial playing card hand including the at least one first playing card of the first side of the at least one selected multi-sided playing card, and (ii) a second partial playing card hand including the at least one second playing card of the second side of the at least one selected multi- sided playing card, (d) receive a selection to play one of: the first partial playing card hand and the second partial playing card hand, (e) if the first partial playing card hand is selected to be played:

(i) select, via the at least one processor, at least one first playing card having at least one side associated with one of the plurality of first playing cards of the first game, (ii) display, via the at least one display device, a first complete playing card hand including the at least one selected first playing card and the first partial playing card hand, (iii) determine, via the at least one processor, if the first complete playing card hand is associated with any awards, said determination being based on a first paytable, and (iv) display, via the at least one display device, any awards associated with the first complete playing card hand, (f) if the second partial playing card hand is selected to be played:

(i) select, via the at least one processor, at least one second playing card having at least one side associated with one of the plurality of second playing cards of the second game, (ii) display, via the at least one display device, a second complete playing card hand including the at least one selected second playing card and the second partial playing card hand, (iii) determine, via the at least one processor, if the second complete playing card hand is associated with any awards, said determination being based on a second paytable, and (iv) display, via the at least one display device, any awards associated with the second complete playing card hand, and (g) if a cashout input is received via the cashout device, cause an initiation of any payout associated with the credit balance.

2. The gaming system of claim 1, wherein when executed by the at least one processor, the plurality of instructions cause the at least one processor to select a plurality of multi-sided playing cards and display: (i) the first partial playing card hand including the plurality of first playing cards of the first sides of the plurality of selected multi-sided playing cards, and (ii) the second partial playing card hand including the plurality of second playing cards of the second sides of the plurality of selected multi-sided playing cards.

3. The gaming system of claim 1, wherein when executed by the at least one processor, the plurality of instructions cause the at least one processor to, for at least one of the multi-sided playing cards, randomly determine the first playing card of the first game and separately randomly determined the second playing card of the second game.

4. The gaming system of claim 1, wherein when executed by the at least one processor, the plurality of instructions cause the at least one processor to sequentially display the first partial playing card hand and the second partial playing card hand.

5. The gaming system of claim 1, wherein when executed by the at least one processor, the plurality of instructions cause the at least one processor to display the first complete playing card hand and the second complete playing card hand.

6. The gaming system of claim 5, wherein when executed by the at least one processor, the plurality of instructions cause the at least one processor to display said first complete playing card hand and the second complete playing card hand prior to receiving the selection of any playing card hands to play.

7. The gaming system of claim 1, wherein when executed by the at least one processor, the plurality of instructions cause the at least one processor to receive a selection to play both the first partial playing card hand and the second partial playing card hand.

8. The gaming system of claim 1, wherein the plurality of first playing cards of the first game are the same as the plurality of second playing cards of the second, different game.

9. The gaming system of claim 1, wherein each multi-sided playing card includes at least a third side associated with one of a plurality of third playing cards of a third, different game.

10. The gaming system of claim 1, wherein at least one of the multi-sided playing cards includes the at least one first playing card having the at least one side associated with one of the plurality of first playing cards of the first game and the at least one second playing card having the at least one side associated with one of the plurality of second playing cards of the second game.

11. The gaming system of claim 1, wherein the first paytable and the second paytable are different.

12. A method of operating a gaming system, said method comprising:

(a) causing at least one processor to execute a plurality of instructions to select at least one multi-sided playing card, each multi-sided playing card having at least:
  (i) a first side associated with one of a plurality of first playing cards of a first game, and
  (ii) a second side associated with one of a plurality of second playing cards of a second, different game,
(b) causing at least one display device to display at least:
  (i) a first partial playing card hand including the at least one first playing card of the first side of the at least one selected multi-sided playing card, and
  (ii) a second partial playing card hand including the at least one second playing card of the second side of the at least one selected multi-sided playing card,
(c) receive a selection to play one of: the first partial playing card hand and the second partial playing card hand,
(d) if the first partial playing card hand is selected to be played:
  (i) causing the at least one processor to execute the plurality of instructions to select at least one first playing card having at least one side associated with one of the plurality of first playing cards of the first game,
  (ii) causing the at least one display device to display a first complete playing card hand including the at least one selected first playing card and the first partial playing card hand,
  (iii) causing the at least one processor to execute the plurality of instructions to determine if the first complete playing card hand is associated with any awards, said determination being based on a first paytable, and
  (iv) causing the at least one display device to display any awards associated with the first complete playing card hand, wherein a credit balance is increasable based on any awards associated with the first complete playing card hand, said credit balance is increasable via an acceptor of a physical item associated with a monetary value, wherein said physical item is selected from the group consisting of: a ticket associated with the monetary value and a unit of currency, and said credit balance is decreasable via a cashout device configured to receive an input to cause an initiation of a payout associated with the credit balance, and
(e) if the second partial playing card hand is selected to be played:
  (i) causing the at least one processor to execute the plurality of instructions to select at least one second playing card having at least one side associated with one of the plurality of second playing cards of the second game,
  (ii) causing the at least one display device to display a second complete playing card hand including the at least one selected second playing card and the second partial playing card hand,
  (iii) causing the at least one processor to execute the plurality of instructions to determine if the second complete playing card hand is associated with any awards, said determination being based on a second paytable, and
  (iv) causing the at least one display device to display any awards associated with the second complete playing card hand, wherein the credit balance is increasable based on any awards associated with the second complete playing card hand.

13. The method of claim 12, which includes:
causing the at least one processor to execute the plurality of instructions to select a plurality of multi-sided playing cards, and
causing the at least one display device to display : (i) the first partial playing card hand including the plurality of first playing cards of the first sides of the plurality of selected multi-sided playing cards, and (ii) the second partial playing card hand including the plurality of second playing cards of the second sides of the plurality of selected multi-sided playing cards.

14. The method of claim 12, which includes, for at least one of the multi-sided playing cards, causing the at least one processor to execute the plurality of instructions to randomly determine the first playing card of the first game and separately randomly determined the second playing card of the second game.

15. The method of claim 12, which includes causing the at least one display device to sequentially display the first partial playing card hand and the second partial playing card hand.

16. The method of claim 12, which includes causing the at least one display device to display the first complete playing card hand and the second complete playing card hand.

17. The method of claim 16, which includes causing the at least one display device to display said first complete playing card hand and the second complete playing card hand prior to receiving the selection of any playing card hands to play.

18. The method of claim 12, which includes receiving a selection to play both the first partial playing card hand and the second partial playing card hand.

19. The method of claim 12, wherein the plurality of first playing cards of the first game are the same as the plurality of second playing cards of the second, different game.

20. The method of claim 12, wherein each multi-sided playing card includes at least a third side associated with one of a plurality of third playing cards of a third, different game.

21. The method of claim 12, wherein at least one of the multi- sided playing cards includes the at least one first playing card having the at least one side associated with one of the plurality of first playing cards of the first game and the at least one second playing card having the at least one side associated with one of the plurality of second playing cards of the second game.

22. The method of claim 12, wherein the first paytable and the second paytable are different.

23. The method of claim 12, which is provided through a data network.

24. The method of claim 23, wherein the data network is an internet.

* * * * *